US005203416A

United States Patent [19]

Takeuchi et al.

[11] Patent Number: 5,203,416

[45] Date of Patent: Apr. 20, 1993

[54] SPRINKLER HEAD

[75] Inventors: Takashi Takeuchi, Kanagawa; Teturo Kikuchi, Iwate, both of Japan

[73] Assignee: Senju Sprinkler Company Limited, Tokyo, Japan

[21] Appl. No.: 753,352

[22] Filed: Aug. 30, 1991

[30] Foreign Application Priority Data

Sep. 4, 1990 [JP] Japan ..... 2-92450[U]

[51] Int. Cl.[5] ..... A62C 37/11

[52] U.S. Cl. ..... 169/39

[58] Field of Search ..... 169/39, 37, 40

[56] References Cited

U.S. PATENT DOCUMENTS

| | | | |
|---|---|---|---|
| 597,115 | 1/1898 | Kersteter | 169/39 |
| 3,161,236 | 12/1964 | Macartney | 169/39 |
| 3,602,314 | 8/1971 | Onuki | 169/39 |
| 4,176,718 | 12/1979 | Vorkapich | 169/39 |
| 4,298,068 | 11/1981 | Bray | 169/39 |
| 4,440,234 | 4/1984 | Shea | 169/39 |

*Primary Examiner*—Russell D. Stormer
*Assistant Examiner*—James M. Kannofsky
*Attorney, Agent, or Firm*—Tarolli, Sundheim & Covell

[57] ABSTRACT

A sprinkler head of a frame-yoke type is provided. The sprinkler head comprises a disassemblable part including a support, a balance, a movable member and a heat-sensitive body. The sprinkler head also includes elements for preventing dislodgement of the balance from the support. These elements are disposed at a position adjacent where the balance and the support engage with each other. The elements for preventing dislodgement of the balance may include protrusions extending outwardly from each sides of the balance body.

5 Claims, 3 Drawing Sheets

SPRINKLER HEAD

BACKGROUND OF THE INVENTION

1. Field of the Invention

This invention relates to a sprinkler head. More specifically, the present invention relates to a sprinkler head of a frame-yoke type which comprises a disassemblable part including a support, a balance, a movable member and a heat-sensitive body.

2. Description of the Prior Art

In a sprinkler head of a frame-yoke type having a substantially V-shaped arm (hereinafter simply referred to as a "sprinkler head"), there are disadvantages in that, upon actuation thereof, a valve member or some components of a disassemblable part sometimes remain on a boss or deflector of the sprinkler head. This is usually called "lodgement".

When a fire breaks out and such a lodgement of a sprinkler head occurs, extinguishant or extinguishiment agent, which should in principle be uniformly distributed around the sprinkler head, is caused to be distributed improperly so that normal or proper extinguishment activity cannot be expected.

It is therefore required that no lodgement occur during actuation of sprinkler heads.

Conventionally, a number of sprinkler heads have been proposed in order to prevent lodgement of a valve member. In this respect, reference should be made to Japanese Utility Model Publications Nos. 57-10698 and 57-42456, and Japanese Utility Model Public Disclosures Nos. 59-26660, 59-102053, 59-159455 and 61-151750.

Conventional sprinkler heads designed to prevent lodgement all are intended to avoid lodgement of a valve member. In such a sprinkler head design, problems of lodgement of components of a disassembable part (simply referred to as "disassemblable components" hereinbelow) were not materially thought of.

Although lodgement of such disassemblable components occurs less frequently with respect to that of valve members, it indeed causes a problem if it occurs.

One component of the disassemblable part which is most likely to cause lodgement is a balance. There are, however, no prior art sprinkler heads in which protection of lodgement of a balance has been considered.

A valve member is singly disposed at an outlet from which extinguishant flows out. Therefore, any suitable counter measures for preventing lodgement of the valve member can be brought in practice by, for example, restricting the valve so that it does not interfere with the outlet or by making the valve member imbalanced so that it is incapable to remain or to be seated on a boss. Contrariwise and with respect to the balance, it is difficult to take a counter measure for avoiding lodgement of a valve member since the valve member is accurately assembled together with the remaining disassemblable components.

SUMMARY OF THE INVENTION

It is therefore an object of the invention to provide a sprinkler head which is configured to prevent lodgement of a balance.

The inventors have found, by deliberately observing sprinkler head under actuation by means of a high-speed VTRa, that lodgement of a balance occurs as follows.

Occurence of lodgement of a balance will be explained below with reference to FIGS. 4 to 7.

FIG. 4 illustrates a disassemblable part prior to actuation, in which reference numeral 10 designates a support, 20 a balance, 30 a movable member and 40 a heat-sentitive body.

FIG. 5 shows the disassemblable part just after actuation. An alloy 42 having a low melting temperature and contained within a cylinder 41 of the heat-sensitive body 40 begins to melt. Thus, a plunger 43 has fallen into the cylinder 41 to cause disengagement between the balance 20 and the movable member 30. At this stage, the balance 20 is displaced in the direction shown by an arrow mark A since the balance 20 is pulled into the cylinder.

FIG. 6 shows that the disassemblable part is further actuated. The movable member 30 is rotated in the direction shown by an arrow mark B due to a leverage action (the horizontal offset between a ball below the support 10 and the support causes leverage action). This rotation of the movable member causes rotation of the support in the direction shown by an arrow mark C. Accordingly, the heat-sensitive body 40 becomes disengaged from the support as the support rotates. This causes the balance to fall or drop in the direction shown by an arrow mark D.

FIG. 7 shows that the disassemblable part is actuated further from the position in FIG. 6. As the support rotates further, the balance becomes disengaged from the opening of the support to remain there.

The balance remaining in a flow path of extinguishant from the sprinkler head is pushed by the flow of extinguishant to be seated on the boss or deflector, thus causing the problem of lodgement.

Considering the above process of lodgement of a balance, the inventors have reached the conclusion that lodgement of a balance can be prevented by avoiding the balance from remaining in the flow path of extinguishant after disassemble of the disassemblable components.

In accordance with the present invention, there is provided a sprinkler head of a frame-yoke type comprising a disassemblable part including a support, a balance, a movable member and a heat-sensitive body. The sprinkler head further comprises means for preventing dislodgement of the balance from the support. This means is disposed at a position adjacent where the balance and the support engage with each other.

BRIEF DESCRIPTION OF THE DRAWINGS

A sprinkler head according to one embodiment of the invention will be explained below in detail with reference to the attached drawings in which.

DESCRIPTION OF THE PREFERRED EMBODIMENT

Figure 1:
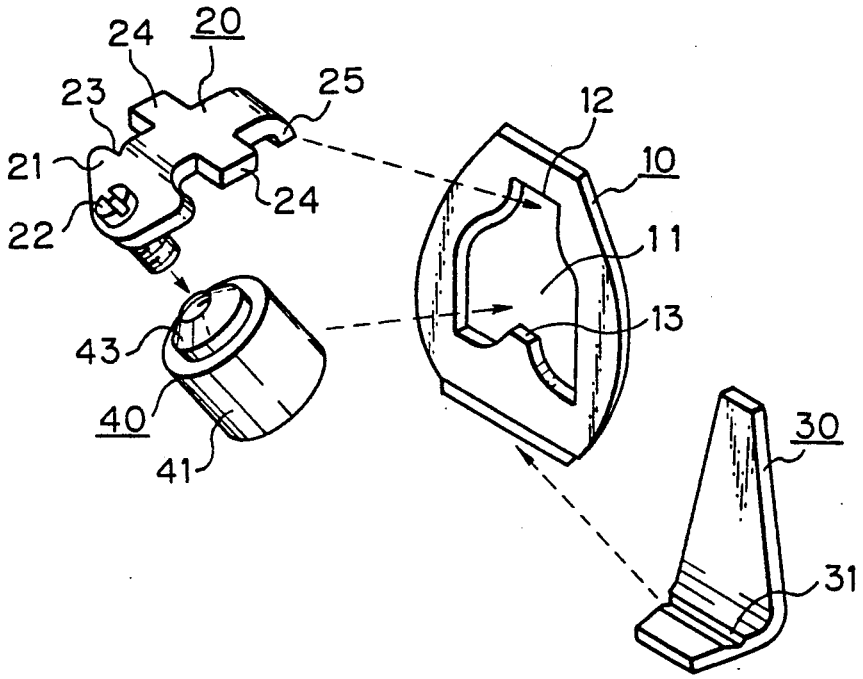
FIG. 1 is an exploded perspective view of a disassemblable part of a sprinkler head of the invention, illustrating the way to assemble the disassemblable part.
Figure 2:
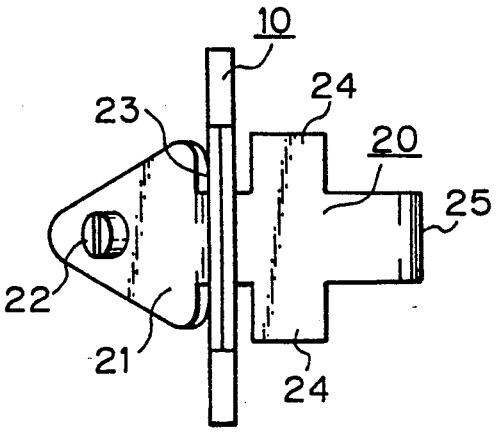
FIG. 2 is a plan view of the disassemblabe part of the sprinkler head of the invention.

A sprinkler head comprises a frame 1 having a bore 2 for introducing water, and a pair of arms 3, 3 extending from the bottom of the frame to form a substantially V-shaped configuration, the intersection of the arms forming a boss 4. In normal state of the sprinkler head according to the invention, the bore 2 for introducing water is closed by a valve member 6, with a disassemblable part 7 being disposed between the valve member 6 and the boss 4. The disassemblable part 7 includes a support 10, a balance 20, a movable member 30 and a heat-sensitive body 40, as shown in FIG. 1.

The support 10 includes an opening 11 for receiving therein the heat-sensitive body 40. The opening 11 includes an upper part with a smaller size serving as a balance carrier 12. The opening 11 also includes a protrusion 13 at the lower part thereof.

Figure 3:
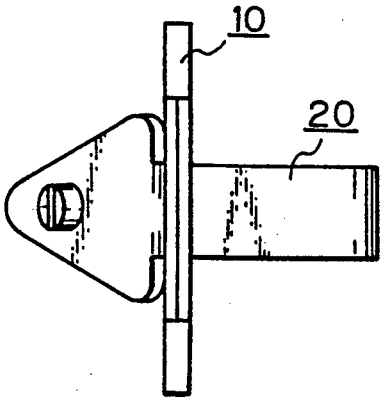
Fig. 3 PRIOR ART
FIG. 3 is a plan view of a disasseblable part of a sprinlker head of a prior art.
Figure 4:
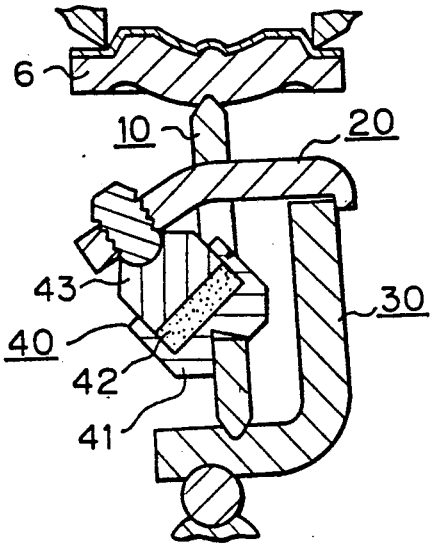
Fig. 4 PRIOR ART
FIGS. 4 to 7 are illustrative view showing process of disassembling the disassemblable part according to prior art.

The balance 20 includes, at one end, a head 21 inclined as shown in FIG. 1. A screw 22 is threadingly attached to the head 21, the head 21 defining outwardly extending portions. A pair of recesses are formed adjacent the outwardly extending portions of the head 21. Each of the recesses form, at their respective longitudinal ends an engagement portion 23 for engagement with the balance carrier 12 of the opening 11 of the support 10 and outwardly extending portions or protrusions 24, 24 for preventing dislodgement of the balance 20 from the support 10. It should be noted that the width, i.e., longitudinal distance, of each of the recesses is slightly larger than the thickness of the support 10 so as to facilitate insertion of the support into the recesses. It should specifically be noted that a sprinkler head of prior art were not formed with such protrusions, as shown in FIG. 3. The other end of the balance 20 is formed with a hook 25 which is bent downwardly, as shown in FIG. 1.

The movable member 30 includes an upper portion and a lower portion connected together to form a L-shaped cross-section as shown in FIG. 1. The movable member 30 includes a groove 31 in the upper surface of the lower portion. The lower portion of the movable member 30 includes in the lower surface thereof a recess for receiving therein a ball positioned at the upper surface of the boss 4. The recess for receiving the ball is offset from the groove 31.

The heat-sensitive body 40 includes a cylinder 41, an alloy 42 of low melting temperature filled withing the cylinder, and a plunger 43 mounted to the low melting point alloy 42. The bottom of the cylinder and the upper portion of the plunger are formed with a groove.

As shown in FIG. 1, the disassemblable part 7 can be assembled by engaging the engagement portion 23 of the balance 20 with the balance carrier 12 of the support 10 and clamping the support 10 between the head 21 and the protrusions 24. Then, the screw 22 of the balance 20 is fitted into the groove of the plunger 43 of the heat-sensitive body 40. Thereafter, the groove at the lower portion of the cylinder 41 of the heat-sensitive body 40 is fitted over a protrusion 13 formed at the lower part of the opening 11 of the support 10. The lower edge of the support 10 is engaged into the groove 31 of the movable member 30 and the movable member, in turn, is engaged at the upper end thereof with the hook 25 of the balance 20. After assembling the disassemblable part 7 as described above, the screw 22 is tightened so as to firmly connect or engage the components relative to one another.

Disassemble of the disassemblable part of the sprinkler head of the invention will be explained hereinbelow.

Figure 5:
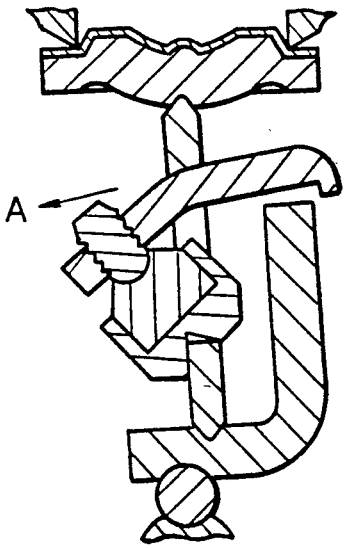
Fig. 5 PRIOR ART
Figure 6:
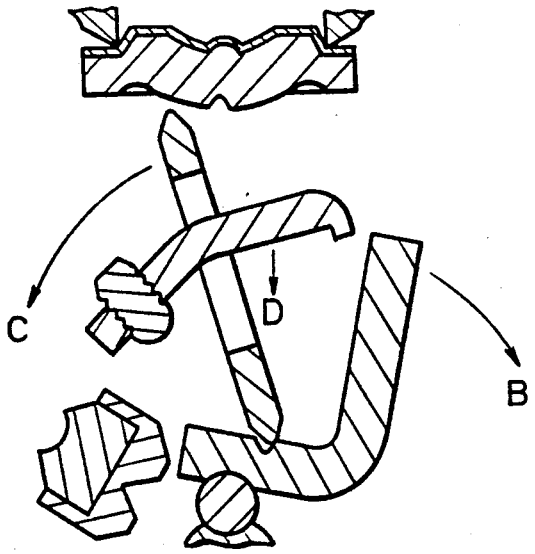
Fig. 6 PRIOR ART
Figure 7:
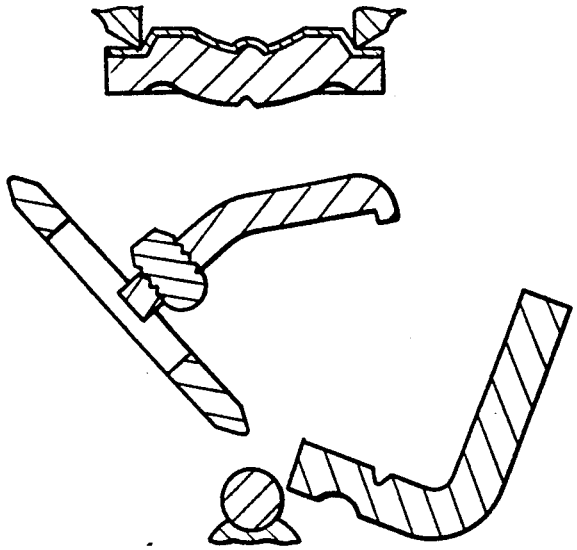
Fig. 7 PRIOR ART
Figure 9:
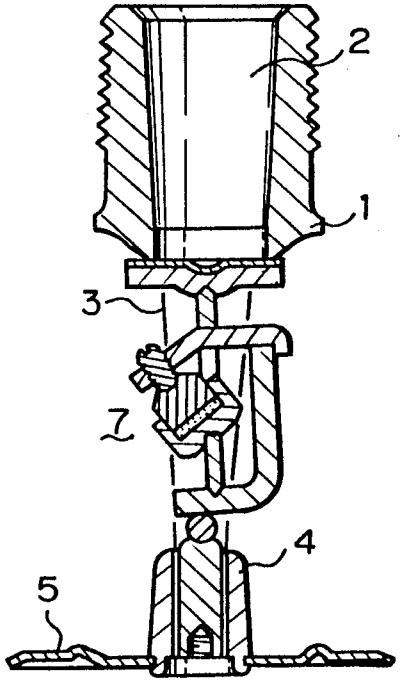
FIG. 9 is a cross-sectional view along line X—X of FIG. 8.
Figure 8:
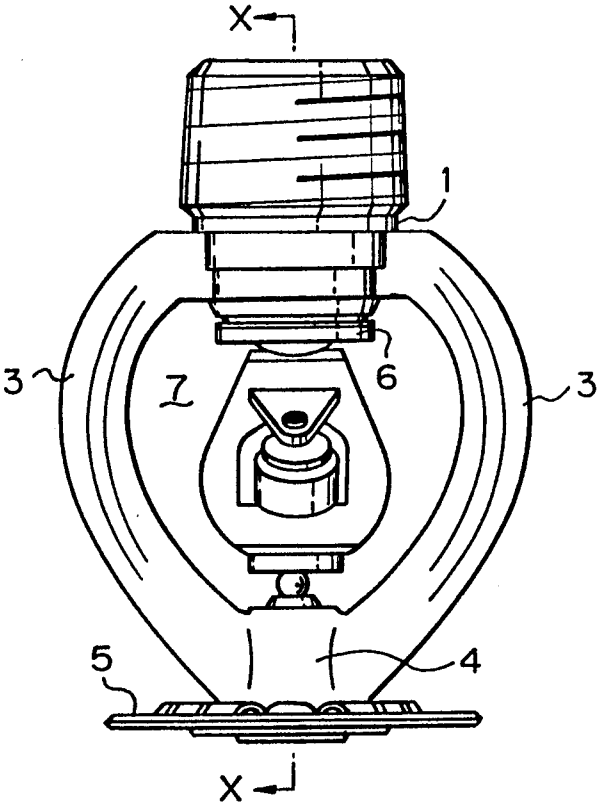
FIG. 8 a plan view of a sprinkler head of a frame-yoke type.

When a fire breaks out and the low melting temperature alloy of the heat-sensitive body 40 melts, the plunger 43 begins to sink into the cylinder 41. Thus, the balance 20 is pulled by the plunger in the direction shown by an arrow mark A in FIG. 5. It is clear, however, that the balance 20 will not be dislodged from the support 10 due to the fact that the balance 20 is formed with the protrusions 24 which engage with the periphery of the opening 11 of the support 10. Further disassemble or dimount of the disassemblable part 7 causes the support 10 to be rotated in the direction shown by an arrow mark C in FIG. 6. At this stage, the support 10 rotates with the balance 20 engaging therewith. Accordingly and consequentuly, the balance 20, together with the support 10, will be dislodged from the sprinkler.

According to the sprinkler head of the invention, the balance 20 of the disassemblable part is always dislodged from the sprinkler head along with the dislodgement of the support 10. Therefore, there is no possibility for the balance 20 to remain in a flow path of extinguish agent. Thus, reliable sprinlking of extinguish agent can be obtained, since no lodgement of the balance occurs.

We claim:

1. A sprinkler head of a frame-yoke type having a disassemblable unit disposed between a valve member and a boss, the disassemblable unit comprising:

a movable member with one end engaging said boss;

a support having an opening and supporting, at one end, said valve member and resting, at the other end, on said one end of said movable member; and a balance member extending through said opening of said support;

said balance member having one end engaging the other end of said movable member;

the other end of said balance member including means for retaining a heat-sensitive body on said support;

said balance member including engaging portions engaging an edge of the opening of said support and protrusions for preventing dislodgement of said balance member from said support.

2. A sprinkler head as set forth in claim 1, wherein said protrusions extend outwardly from each side of a body of said balance member.

3. A sprinkler head for dispensing fire extinguishant including a frame with a bore through which the fire extinguishant may flow, a movable valve member for blocking the bore to control flow of the fire extinguishant, a boss located opposite said valve member and fixed to said frame by arm means, and a unit positioned between said valve member and said boss for holding said valve member in a closed position to block flow of fire extinguishant prior to disassembly of said unit and for releasing said valve member and for falling clearly away from said sprinkler head to permit flow of fire extinguishant upon disassembly of said unit in response to fire heat, said unit comprising:

a first member having a first portion abutting said boss and a second portion extending away from said boss;

a second member having a first portion abutting said first portion of said first member and a second portion abutting said valve member to hold said valve member closed prior to disassembly of said unit, said first member holding said second member in engagement with said valve member prior to disassembly of said unit and moving relative to said second member upon disassembly of said unit to release said second member from holding said valve member, said second member having surface means which define an opening;

a third member extending through the opening in said second member, said third member having outwardly extending portions positioned on either side of said second member for retaining said third member with the second member upon disassembly of said unit to ensure that the third member falls clearly away from said sprinkler head, said third member having first and second portions located on either side of said second member and being pivotable relative to said second member, said first portion of said third member engaging said second portion of said first member to prevent movement of said first member relative to said second member when said third member is in a first pivot position; and a fourth member extending between said second portion of said third member and said surface means of said second member which define the opening to hold said third member in the first pivot position, said fourth member including means for pivoting said third member away from the first pivot position relative to said second member upon heating of the fourth member by a fire to permit said first member to move relative to said second member to cause disassembly of said unit.

4. A sprinkler head as set forth in claim 3, wherein said first portion of said third member includes a hook for engaging said second portion of said first member.

5. A sprinkler head as set forth in claim 3, wherein said outwardly extending portions of said third member partially overlay said second member.

* * * * *